US005690023A

United States Patent [19]

Stamm et al.

[11] Patent Number: 5,690,023

[45] Date of Patent: Nov. 25, 1997

[54] TENSIONING AND SEALING APPARATUS FOR STRAPPING AN OBJECT WITH A BAND

[75] Inventors: Nikolaus Stamm, Thalwil; Flavio Finzo, Würenlos, both of Switzerland

[73] Assignee: Orgapack AG, Dietikon, Switzerland

[21] Appl. No.: 652,934

[22] Filed: May 24, 1996

[30] Foreign Application Priority Data

May 26, 1995 [CH] Switzerland ..... 01571/95

[51] Int. Cl.[6] ..... B65B 13/18

[52] U.S. Cl. ..... 100/29; 100/32; 100/33 PB; 156/73.5; 156/494; 156/502

[58] Field of Search ..... 100/29, 32, 33 PB; 156/73.5, 494–496, 502

[56] References Cited

U.S. PATENT DOCUMENTS

| | | | |
|---|---|---|---|
| 3,396,889 | 8/1968 | Annis, Jr. . | |
| 4,313,779 | 2/1982 | Nix | 156/73.5 |
| 4,450,032 | 5/1984 | Wehr | 100/33 PB |
| 5,024,149 | 6/1991 | Kato | 100/29 |
| 5,380,393 | 1/1995 | Drabarek et al. | 100/33 PB |
| 5,476,569 | 12/1995 | Harada | 100/33 PB |

FOREIGN PATENT DOCUMENTS

| | | |
|---|---|---|
| 0 187 942 | 7/1986 | European Pat. Off. . |
| 32 29 870 | 7/1992 | Germany . |

*Primary Examiner*—Stephen F. Gerrity

*Attorney, Agent, or Firm*—Cushman Darby & Cushman Intellectual Property Group of Pillsbury Madison & Sutro LLP

[57] ABSTRACT

A tensioning and sealing apparatus for strapping an object with a band exhibits a tensioning unit (3) for retaining and tensioning two ends of the band which are to be sealed as well as a sealing unit for connecting the two mutually overlapping ends. The tensioning unit (3) has a motor drive (12) and comprises a tensioning shoe (5) and a drivable tensioning wheel (8) which is fastened on a pivotable rocker (6) and is intended for pressing the band against the tensioning shoe (5) and for gripping the same upon rotation. In order to achieve a high overall efficiency of the tensioning drive, the drive motor (12) of the tensioning wheel (8) is arranged coaxially with the tensioning wheel (8) and is connected to the tensioning wheel (8) via a gear mechanism arranged coaxially with the tensioning wheel (8).

8 Claims, 3 Drawing Sheets

TENSIONING AND SEALING APPARATUS FOR STRAPPING AN OBJECT WITH A BAND

BACKGROUND OF THE INVENTION

The invention relates to a tension and sealing apparatus for strapping an object with a band, which apparatus comprises a housing having a tensioning unit for retaining two ends of the bands which are to be sealed and for tensioning the same and having a sealing unit for connecting the two mutually overlapping ends, the tensioning unit exhibiting a tensioning shoe and a drivable tensioning wheel which is fastened on a pivotable rocker and is intended for pressing the band against the tensioning shoe and for gripping the same upon rotation.

Such an apparatus is known from German Patent Specification DE 32 29 870 C2. This document gives the description of a band strapping apparatus in which a single drive motor is provided for alternatively driving the tensioning wheel and the sealing device, which drive motor, together with a reduction gear mechanism in a gear-mechanism housing can be positioned as a structural unit on the housing of the band strapping apparatus and can be connected thereto, with the result that the drive device can be exchanged. The drive motor and the reduction gear mechanism are arranged parallel to one another and also parallel to the tensioning shaft and are connected to one another via gear wheels.

Further known apparatuses make use of angularly arranged motors with worm gear mechanisms or so-called Spiroid gear mechanism.

SUMMARY OF THE INVENTION

The object of the invention is to provide a tensioning and sealing apparatus of the generic type in the case of which the drive of the tensioning wheel is of a simple construction and has a high efficiency.

Said object is achieved according to the invention in that the tensioning wheel is driven with the aid of a drive motor which is arranged coaxially with the tensioning wheel and is connected to the tensioning wheel via a gear mechanism arranged coaxially with the tensioning wheel. This means that less friction losses occur, with the result that a high overall efficiency of the tensioning-wheel drive is achieved. In addition, construction is simple and compact.

Advantageous developments of the invention are given in the subclaims.

According to one embodiment of the invention, the tensioning wheel exhibits an inner cutout, at least part of the gear mechanism being accommodated in the cutout of the tensioning wheel. This means that a large amount of space is saved.

According to a further embodiment of the invention, the apparatus is provided with a separate drive motor for the sealing device. Each motor can be adapted optimally to the respective requirements.

According to a further embodiment of the invention, the two drive motors can be fed by means of an accumulator. The high efficiency of the tensioning-wheel drive according to the invention permits cost-effective accumulator operation.

BRIEF DESCRIPTION OF THE DRAWINGS

An exemplary embodiment of the invention is explained in more detail hereinbelow with reference to the drawings, in which.

DETAILED DESCRIPTION OF THE PREFERRED EMBODIMENTS

Figure 1:
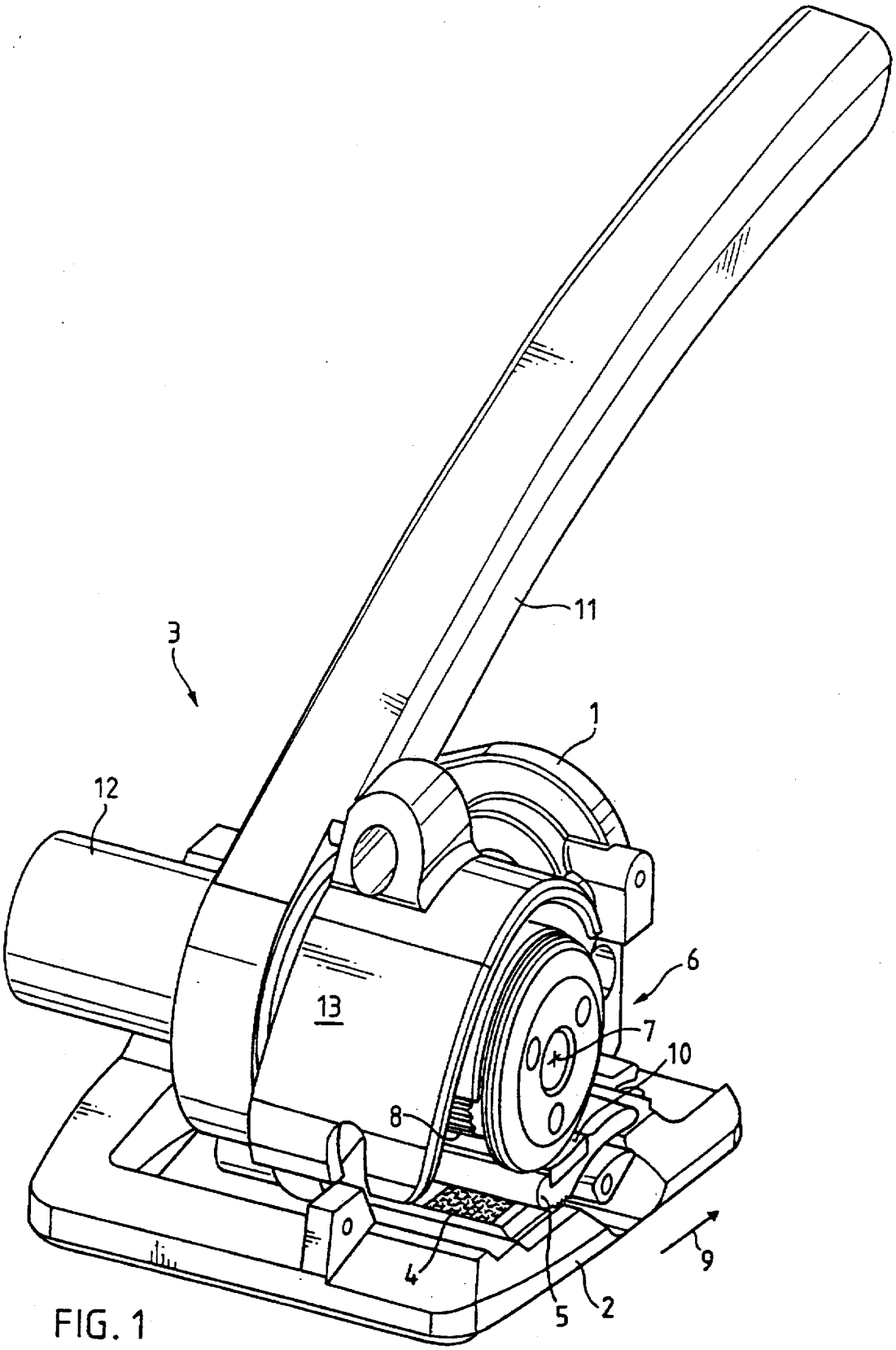
FIG. 1 shows a perspective view of the apparatus according to the invention.

The tensioning and sealing apparatus according to the invention is represented schematically in a perspective view in FIG. 1. It comprises a housing 1 with a base plate 2 on which there are fastened a tensioning unit 3 and a sealing unit (not shown) which is known per se.

During use, the apparatus is positioned with the base plate 2 on an object which is to be strapped with a, for example, thermoplastic band. The band is laid around the object, and two of its ends which are to be sealed are retained by the tensioning unit 3. The sealing unit is suitable for connecting, in a manner known per se, the two mutually overlapping ends, for example by friction welding, once the band has been tensioned. If the band is unwound from a supply reel, a severing device (not shown) of the tensioning unit 3 may be arranged downstream in order to sever the required band section from the supply reel.

The tensioning unit 3 exhibits a fixed toothed plate 4 for bearing the lower band end which is to be sealed. A movable tensioning shoe 5 is toothed on the underside for interaction with the toothed plate 4. The upper side of the tensioning shoe 5 exhibits a bearing surface 10 which is suitable for bearing the upper band end which is to be sealed. Furthermore, provision is made for a pivotable rocker 6 with a toothed, drivable tension wheel 8 which can be rotated about a tensioning axis 7 and is intended for pressing the upper end of the band against the tension shoe 5 and for gripping the upper end upon rotation of the tension wheel 8, with the result that the band is tensioned in the tensioning direction 9 in a manner known per se.

In the exemplary embodiment shown, the axis of rotation of the pivotable rocker 6 is arranged approximately between the tensioning shoe 5 and the base plate 2 and downstream of the bearing surface 10 of the tensioning shoe 5, as seen in the tensioning direction 9. Consequently, the rocker 6 with its tensioning wheel 8 can be raised again, without a large amount of force being expended, in each use position of the apparatus, in particular when the band is tensioned. However, this arrangement of the rocker 6 is not fundamental to the invention.

The rocker 6 with the tensioning wheel 8 can be pivoted by means of the actuation of a lever 11. When it is pivoted rearwards in the tensioning direction 9, the tensioning shoe 5 can be raised from the toothed plate 4, with the result that the lower band end which is to be sealed can be introduced between the toothed plate 4 and the tensioning shoe 5. The lower band end is then clamped in, and the tensioning wheel 8 is retained at a distance from the tensioning shoe 5, with the result that the upper band end which is to be sealed can be introduced between the tensioning shoe 5 and the tensioning wheel 8. If the rocker 6 is pivoted forwards in the tensioning direction 9, the tensioning wheel 8 is pressed against the bearing surface of the tensioning shoe 5 and clamps in the upper band end, with the result that the tensioning operation can be carried out by the tensioning wheel 8 being rotated.

For tensioning the band when the tensioning wheel 8 is bearing on the tension shoe 5, the tensioning wheel 8 is driven by means of a motor 12 which is arranged coaxially with the tensioning wheel 8 and is connected to the tensioning wheel 8 via a gear mechanism which is likewise arranged coaxially with the tensioning wheel 8 and is known per se, for example a planet gear mechanism. The rotational speed of the drive motor 12 is reduced to the desired amount with the aid of the planet gear mechanism, which is mounted coaxially with the tensioning axis 7 beneath the rocker cover 13. This arrangement permits a very compact construction and a high overall efficiency of the tensioning drive. This is fundamental in the case of a tensioning unit with accumulator operation.

Both the sealing unit and the tensioning unit 3 are driven by motor, it being possible for the drive motor 12 of the tensioning device and also the motor of the sealing device to be fed by an accumulator.

During the tensioning operation, the tensioning wheel 8, which is likewise mounted coaxially with the tensioning axis 7, is driven by means of the motor 12, with the result that it is rotated in the anticlockwise direction and tensions the band in the tensioning direction 9. A non-return lock (not shown) ensures that the tensioning wheel 8 can be rotated only in the tensioning direction 9. A sealing button (not shown) is used, after the tensioning operation, to activate the sealing unit for the friction welding of the ends of the tensioned band. Since the sealing unit is arranged downstream of the tensioning wheel 8, as seen in the tensioning direction 9, the upper band end is not tensioned in the sealing unit. This is advantageous for the friction welding of the two mutually overlapping ends of the band, since it is easier to make a non-tensioned band section vibrate than a tensioned one.

An electric motor or a compressed-air motor may be used, for example, as drive motor 12. A brushless DC motor, which can be actuated with the direct current of the accumulator, is advantageously selected. The torque of the drive motor 12 of the tensioning wheel 8 can be adjusted, with the result that it is possible to set corresponding band-tensioning ranges for different objects which are to be strapped.

Figure 2:
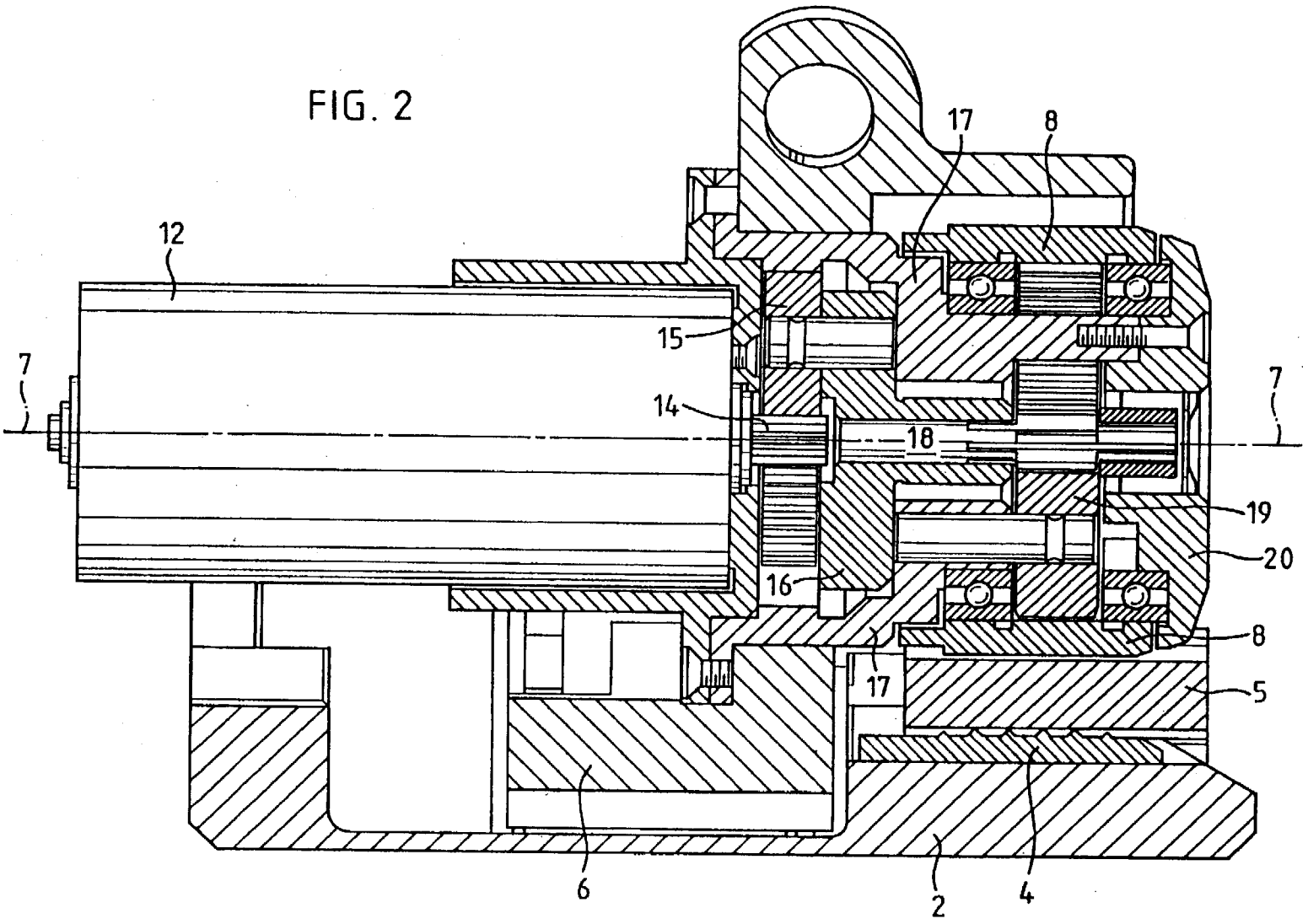
FIG. 2 shows a sectional view of the apparatus according to FIG. 1.

FIG. 2 shows a sectional view of the apparatus according to the invention. The drive motor 12 is, for example, a brushless DC motor which is arranged coaxially with the tensioning wheel 8 and with the gear mechanism. In the embodiment shown, the gear mechanism is a two-stage planet gear mechanism which is known per se. The motor pinion 14 of the drive motor 12 interacts with the planet wheel 15 of the first reduction stage. The planet wheels 15 of the first stage are mounted on the planet wheel carrier 16 of the first stage. The rotational speed of the drive motor 12 is further reduced to the desired amount, and the tensioning wheel 8 is driven, by means of the planet wheel carrier 17 of the second reduction stage, the pinion 18 of the second stage and the planet wheels 19 of the second stage.

The tensioning wheel 8 advantageously exhibits an inner cutout, and part of the planet gear mechanism is accommodated in a space-saving manner in said cutout. For this reason, the tensioning wheel 8 is designed, for example, as the lateral surface of a cylinder or in the form of a ring or as a cylindrical ring, the inside being configured in a toothed manner. The rocker 6 is closed off by means of a cover 20.

The apparatus is provided with a separate drive motor (not shown) known per se for the sealing device. As a result, each motor can be adapted optimally to the respective requirements. The two drive motors can be fed by means of a single accumulator (not shown) which is likewise known per se. Cost-effective accumulator operation is permitted by the high efficiency of the tensioning-wheel drive according to the invention.

Figure 3:
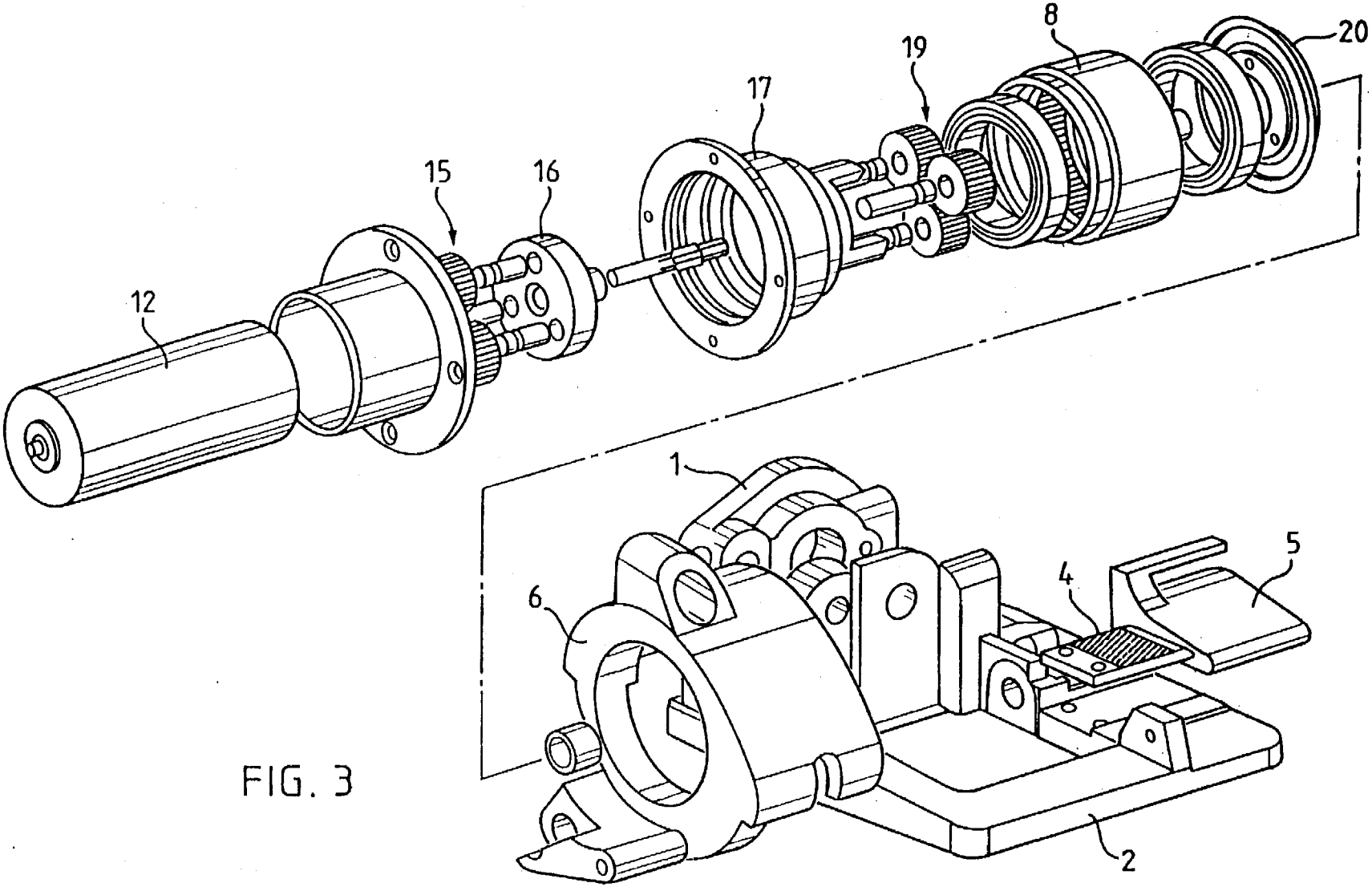
FIG. 3 shows an exploded view, in perspective, of a part of the apparatus of FIG. 1.

An exploded view, in perspective, of the tensioning drive of the apparatus is represented in FIG. 3. The planet wheels 15 and the planet wheel carrier 16 form the first reduction stage. The planet wheel carrier 17 and the planet wheels 19 form the second reduction stage. Of course, use may also be made of a different gear mechanism, for example a harmonic drive.

What we claim is:

1. Tensioning and sealing apparatus for strapping an object with a band, which apparatus comprises a housing (1) having a tensioning unit (3) for retaining two ends of the bands which are to be sealed and for tensioning the same and having a sealing unit for connecting the two mutually overlapping ends, the tensioning unit (3) exhibiting a tensioning shoe (5) and a drivable tensioning wheel (8) which is fastened on a pivotable rocker (6) and is intended for pressing the band against the tensioning shoe (5) and for gripping the same upon rotation, characterized in that the tensioning wheel (8) is driven with the aid of a drive motor (12) which is arranged coaxially with the tensioning wheel (8) and is connected to the tensioning wheel (8) via a gear mechanism arranged coaxially with the tensioning wheel (8).

2. Apparatus according to claim 1, characterized in that the drive motor (12) for the tensioning wheel (8) is an electric motor or a compressed-air motor.

3. Apparatus according to claim 1, characterized in that the tensioning wheel (8) exhibits an inner cutout, and at least part of the gear mechanism is accommodated in the cutout of the tensioning wheel (8).

4. Apparatus according to claim 3, characterized in that the tensioning wheel (8) is designed as a cylindrical ring, the inner side being configured in a toothed manner.

5. Apparatus according to claim 1, characterized in that the gear mechanism is a planet gear mechanism (14, 15, 16, 17, 18, 19).

6. Apparatus according to claim 1, characterized in that the apparatus is provided with a separate drive motor for the sealing device.

7. Apparatus according to claim 6, characterized in that the two drive motors can be fed by means of an accumulator.

8. Apparatus according to claim 1, characterized in that the torque of the drive motor (12) of the tensioning wheel (8) can be adjusted.

* * * * *